US007921501B2

(12) United States Patent
Yu

(10) Patent No.: US 7,921,501 B2
(45) Date of Patent: Apr. 12, 2011

(54) ERASER FOR BLACKBOARD

(76) Inventor: Ming-Feng Yu, Taichung (TW)

( * ) Notice: Subject to any disclaimer, the term of this patent is extended or adjusted under 35 U.S.C. 154(b) by 120 days.

(21) Appl. No.: 12/484,450

(22) Filed: Jun. 15, 2009

(65) Prior Publication Data

US 2010/0313381 A1 Dec. 16, 2010

(51) Int. Cl.
*A47L 13/38* (2006.01)
*B43L 21/00* (2006.01)

(52) U.S. Cl. ..... 15/221; 15/210.1

(58) Field of Classification Search ..... 15/209.1, 15/210.1, 221
See application file for complete search history.

(56) References Cited

U.S. PATENT DOCUMENTS

| | | | | |
|---|---|---|---|---|
| 511,812 | A * | 1/1894 | Spence | 15/221 |
| 647,013 | A * | 4/1900 | Mecredy | 15/221 |
| 4,007,509 | A * | 2/1977 | Odhner | 15/207.2 |
| 6,895,627 | B1 * | 5/2005 | Lin | 15/98 |

* cited by examiner

*Primary Examiner* — Randall Chin
(74) *Attorney, Agent, or Firm* — Alan Kamrath; Kamrath & Associates PA

(57) ABSTRACT

An eraser includes a housing (20) having a receiving chamber (21), a collection zone (23) and a plurality of reinforcing ribs (26), a mounting board (30) mounted on the housing, a cleaning member (40) mounted on the mounting board, a support bracket (50) mounted on the housing, a door (60) removably mounted on the housing to cover the collection zone, a hollow separation member (70) mounted in the housing to separate the receiving chamber from the collection zone, and a control valve (80) movable to open the separation member so as to connect the receiving chamber with the collection zone or to close the separation member so as to interrupt a connection between the receiving chamber and the collection zone, and two decorative covers mounted on the housing and each abutting the reinforcing ribs.

20 Claims, 12 Drawing Sheets

ERASER FOR BLACKBOARD

BACKGROUND OF THE INVENTION

1. Field of the Invention

The present invention relates to an eraser and, more particularly, to an eraser for erasing and cleaning chalks on a blackboard.

2. Description of the Related Art

A conventional eraser in accordance with the prior art shown in FIG. 12 comprises a support plate 10 and a wiping portion 11 mounted on the support plate 10. Thus, the wiping portion 11 is moved on a blackboard reciprocally to erase and remove chalks from the blackboard so as to clean the blackboard. However, when a user wishes to clear the eraser, he/she needs to clap, beat or strike the wiping portion 11 so as to bump and remove the chalks from the wiping portion 11, thereby causing inconvenience and danger to the user.

BRIEF SUMMARY OF THE INVENTION

The primary objective of the present invention is to provide an eraser, wherein the chalks on the blackboard are delivered through the guide slots and the cleaning portions of the first cleaning unit, the cleaning holes of the second cleaning unit and the connecting holes of the mounting board into the receiving chamber of the housing, so that the user can operate the cleaning member easily and efficiently to place and store the chalks in the collection zone of the housing without having to clear the cleaning face of the cleaning member frequently.

Another objective of the present invention is to provide an eraser, wherein the decorative covers abut the respective reinforcing ribs of the housing to enhance the whole strength of the housing.

A further objective of the present invention is to provide an eraser, wherein the decorative covers facilitate a user holding the housing.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
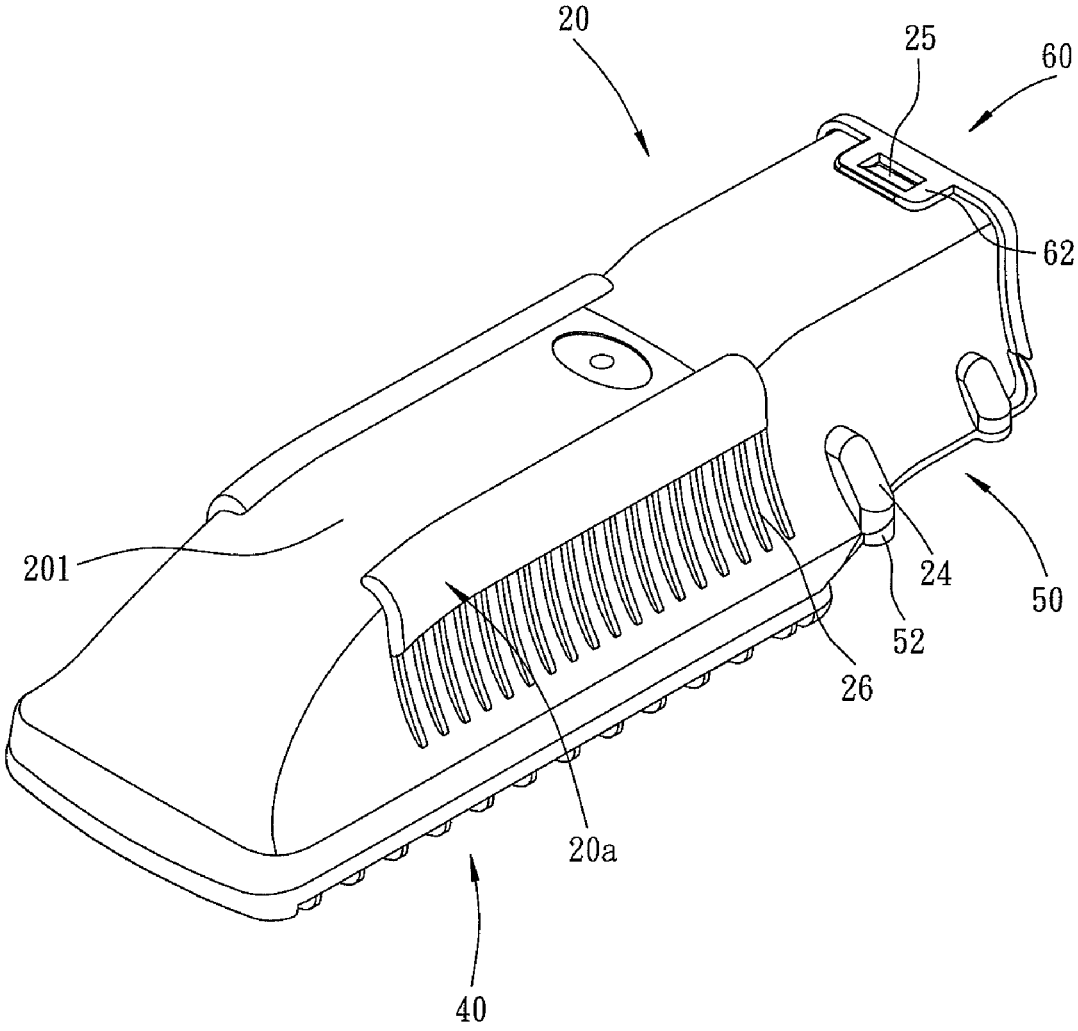
FIG. 1 is a perspective view of an eraser in accordance with the preferred embodiment of the present invention.
Figure 2:
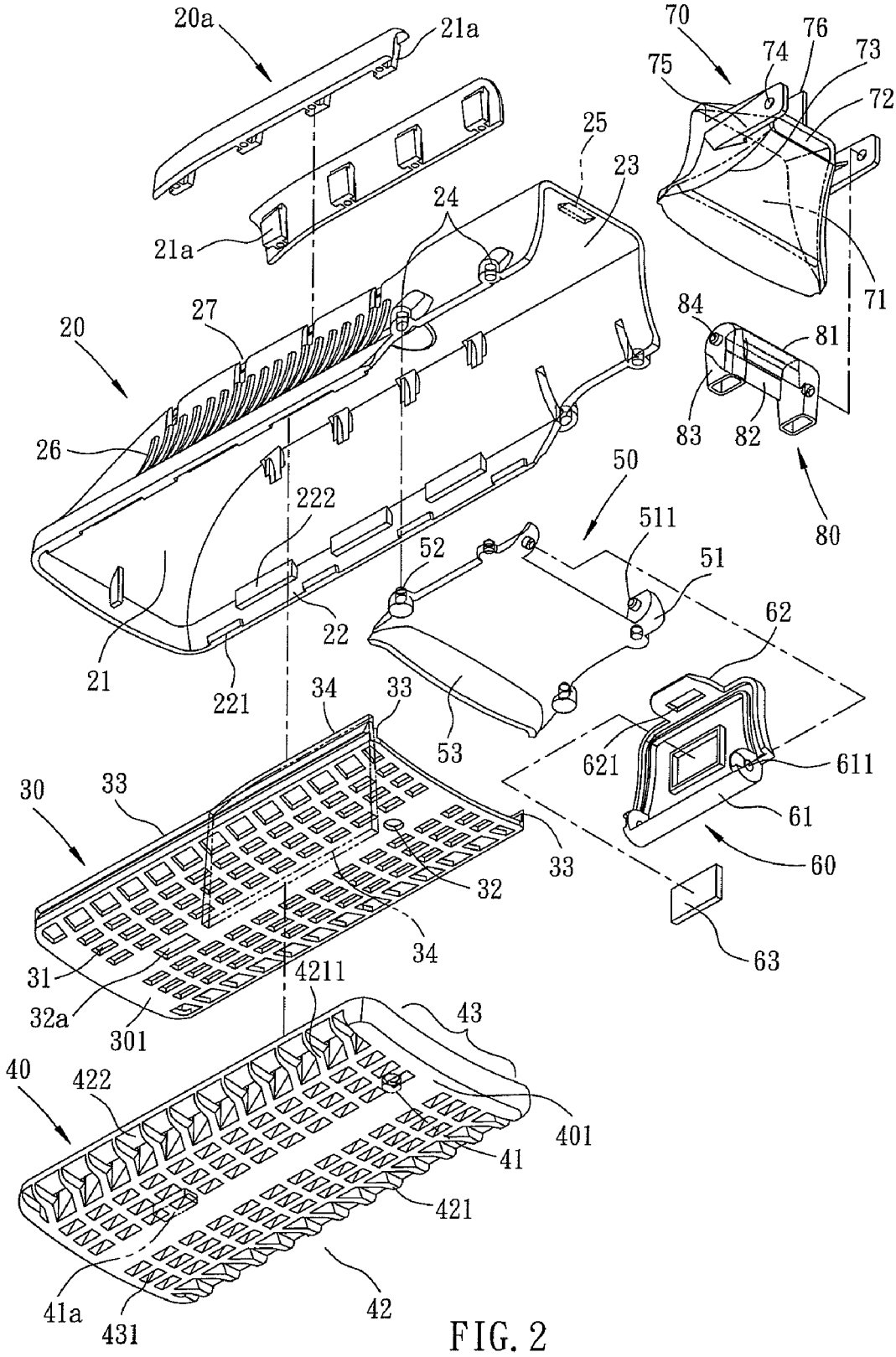
FIG. 2 is an exploded perspective view of the eraser as shown in FIG. 1.
Figure 3:
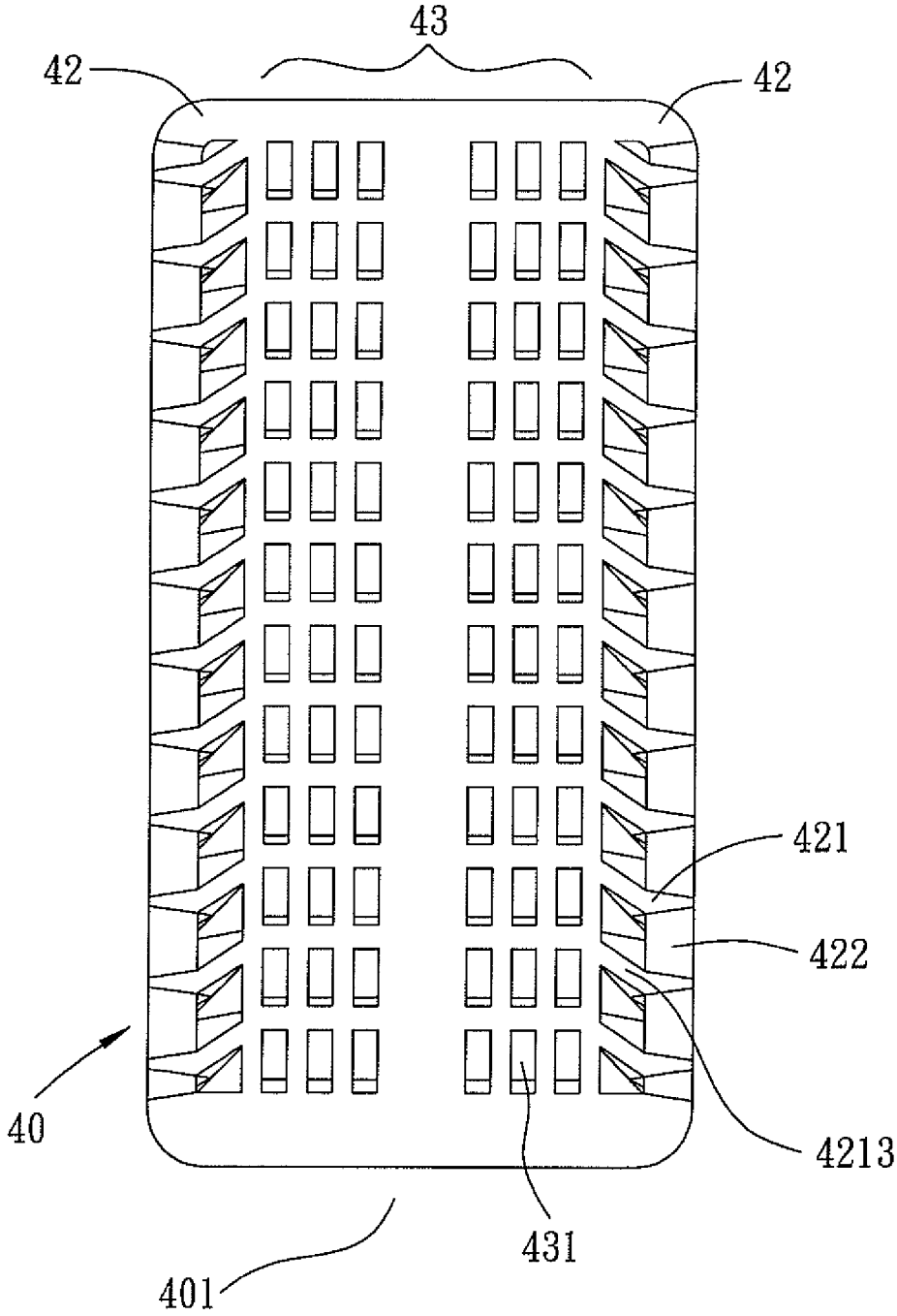
FIG. 3 is a bottom view of a cleaning member of the eraser as shown in FIG. 2.
Figure 4:
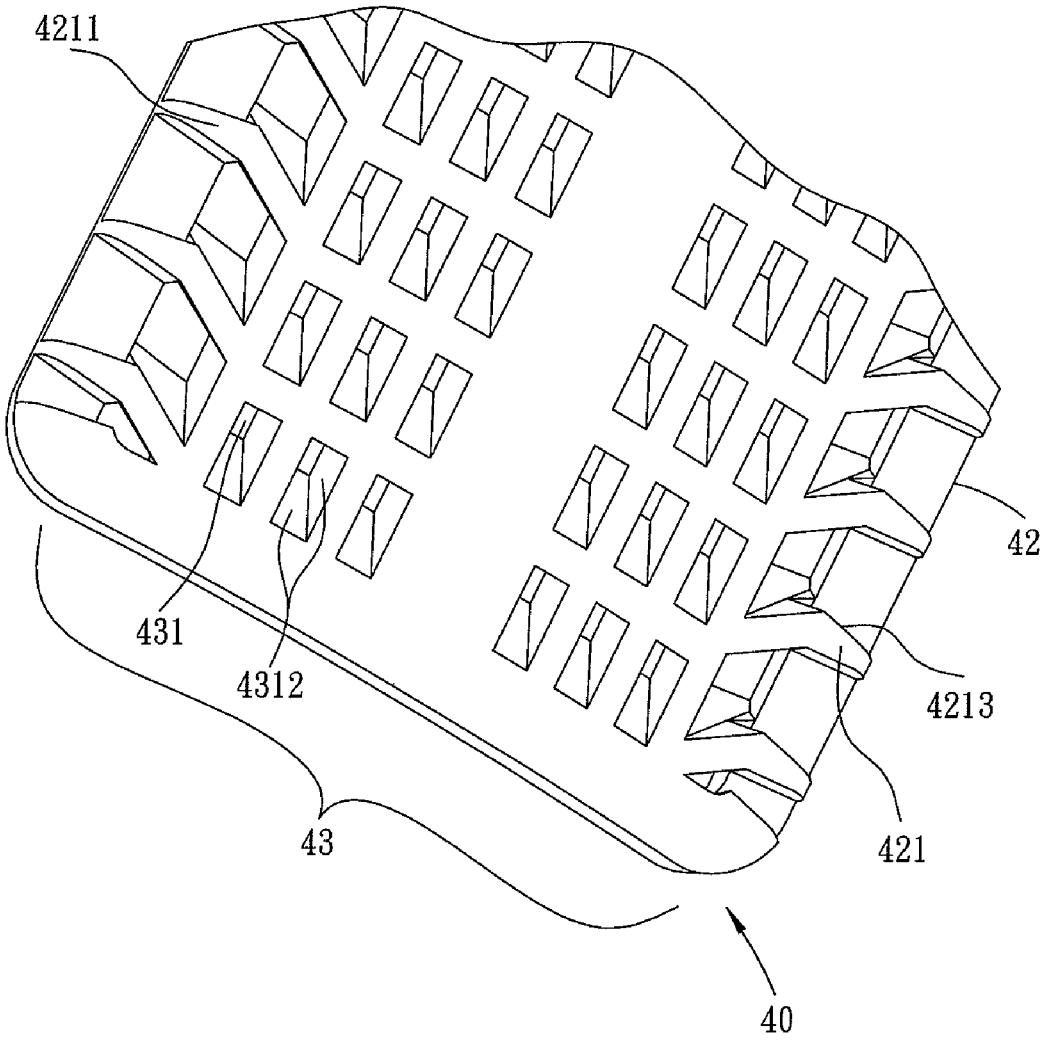
FIG. 4 is a perspective view of the cleaning member of the eraser as shown in FIG. 3.

Referring to the drawings and initially to FIGS. 1-7, an eraser in accordance with the preferred embodiment of the present invention comprises a housing 20 having an inner portion provided with a receiving chamber 21 and a collection zone 23 connected to the receiving chamber 21 and having two opposite sides each provided with a plurality of reinforcing ribs 26, a mounting board 30 mounted on an open bottom of the housing 20 and connected to the receiving chamber 21 of the housing 20, a cleaning member 40 mounted on the mounting board 30 and connected to the receiving chamber 21 of the housing 20, a support bracket 50 mounted on the open bottom of the housing 20 and connected to the collection zone 23 of the housing 20, a door 60 pivotally mounted on the support bracket 50 and removably mounted on the housing 20 to cover the collection zone 23 of the housing 20, a hollow separation member 70 mounted in the housing 20 and located between the receiving chamber 21 and the collection zone 23 of the housing 20 to separate the receiving chamber 21 of the housing 20 from the collection zone 23 of the housing 20, and a control valve 80 pivotally mounted on the separation member 70 and movable relative to the separation member 70 to open the separation member 70 so as to connect the receiving chamber 21 of the housing 20 with the collection zone 23 of the housing 20 or to close the separation member 70 so as to interrupt a connection between the receiving chamber 21 and the collection zone 23 of the housing 20, and two decorative covers 20*a* mounted on the two opposite sides of the housing 20 and each abutting the respective reinforcing ribs 26 of the housing 20 to enhance a whole strength of the housing 20.

The housing 20 has a plurality of fixing grooves 27 and a plurality of sockets 24. The housing 20 has a top face 201 provided with a locking block 25. The receiving chamber 21 of the housing 20 has two opposite sides each provided with at least one slot 22. The slot 22 of the housing 20 consists of two retaining blocks 221 and a limit block 222 arranged between the two retaining blocks 221.

Each of the decorative covers 20*a* has an arc-shaped profile and has a plurality of fixing blocks 21*a* locked in the fixing grooves 27 of the housing 20.

The mounting board 30 has an arc-shaped support face 301 abutting the cleaning member 40. The mounting board 30 has a plurality of connecting holes 31 each connected to the receiving chamber 21 of the housing 20. The mounting board 30 has a plurality of positioning holes 32 and 32*a* having rectangular and circular shapes. The mounting board 30 has two opposite sides each provided with at least one insert 33 inserted into and locked in the slot 22 of the housing 20. The mounting board 30 has an upright plate 34 received in the receiving chamber 21 of the housing 20.

The cleaning member 40 is made of a foam material. The cleaning member 40 laminates the mounting board 30 and has an arc-shaped cleaning face 401. The cleaning member 40 has a first cleaning unit 42 including a plurality of cleaning portions 421 and a second cleaning unit 43 including a plurality of cleaning holes 431 aligning with and connected to the connecting holes 31 of the mounting board 30 respectively. The first cleaning unit 42 of the cleaning member 40 further includes a plurality of guide slots 422 arranged between the cleaning portions 421. Each of the cleaning portions 421 of the first cleaning unit 42 has an arcuate guide face 4211 and an oblique scraping face 4213. Each of the cleaning holes 431 of the second cleaning unit 43 has at least one ramp 4312. The cleaning member 40 has a plurality of positioning blocks 41 and 41*a* having rectangular and circular shapes and inserted into and secured in the positioning holes 32 and 32*a* of the mounting board 30 to secure the cleaning member 40 to the mounting board 30.

The support bracket 50 has a plurality of plugs 52 inserted into the sockets 24 of the housing 20 to secure the support bracket 50 to the housing 20. The support bracket 50 has a downward inclined resting portion 53 abutting the mounting board 30 and the separation member 70. The support bracket 50 has two pivot ears 51 each having a pivot stub 511.

The door 60 has a first end provided with a pivot shaft 61 pivotally mounted between the pivot ears 51 of the support bracket 50 and having two pivot holes 611 each pivotally mounted on the pivot stub 511 of the respective pivot ear 51. The door 60 has a second end provided with a flexible locking plate 62 having a locking hole 621 detachably locked onto the locking block 25 of the housing 20 to removably lock the door 60 onto the housing 20. A magnet 63 is mounted on the door 60.

The separation member 70 has a first end provided with an opening 71 connected to the receiving chamber 21 of the housing 20 and a second end provided with a connecting bore 72 connected to the collection zone 23 of the housing 20. The opening 71 of the separation member 70 is flush with an inner wall of the housing 20 and has a bottom abutting the mounting board 30. The separation member 70 has a tapered guide face 73 located between the opening 71 and the connecting bore 72. The guide face 73 of the separation member 70 is tapered from the opening 71 to the connecting bore 72. The separation member 70 has an upright resting plate 76 abutting a top wall of the housing 20. The separation member 70 has two protruding support plates 75 each having a pivot bore 74.

Figure 5:
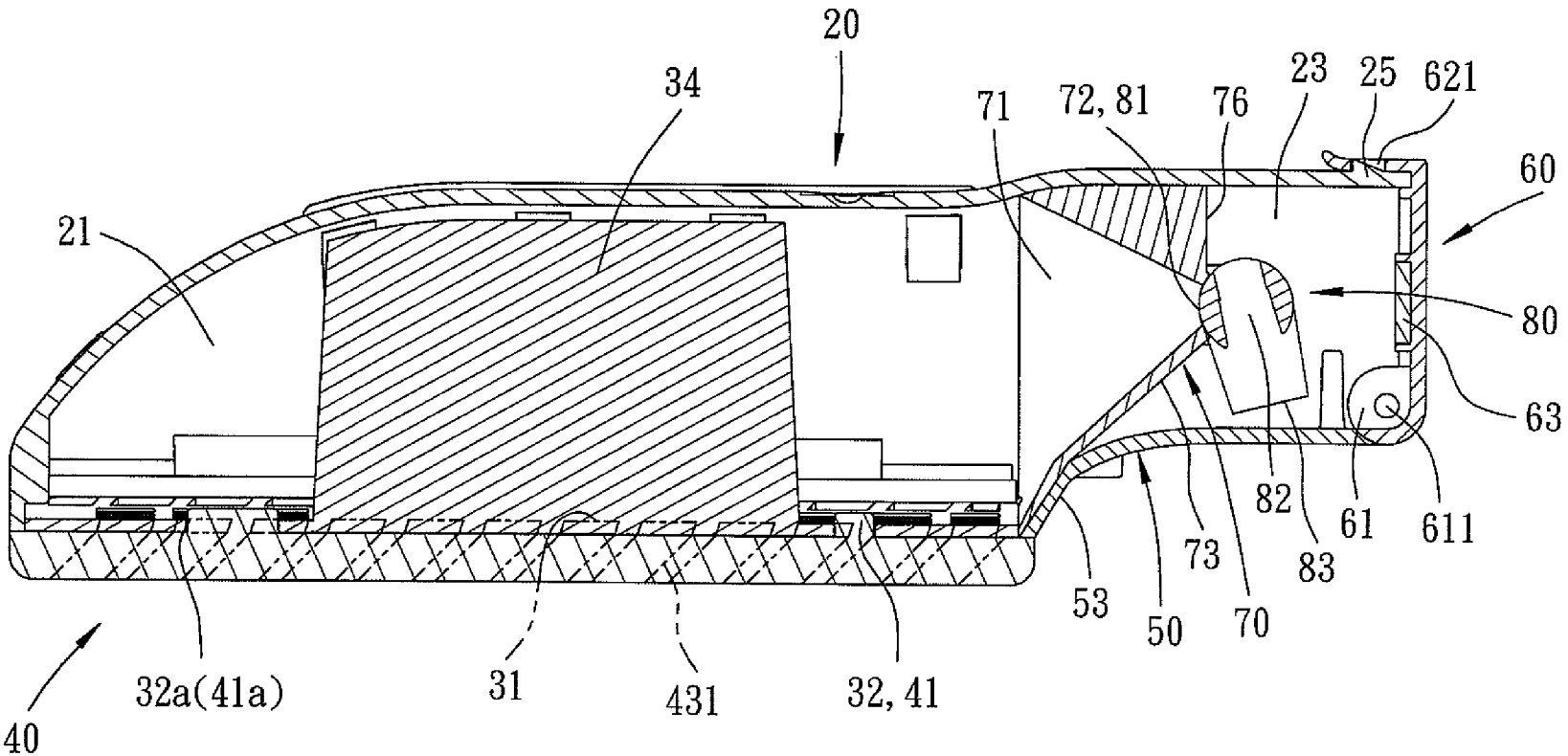
FIG. 5 is a side cross-sectional view of the eraser as shown in FIG. 1.
Figure 6:
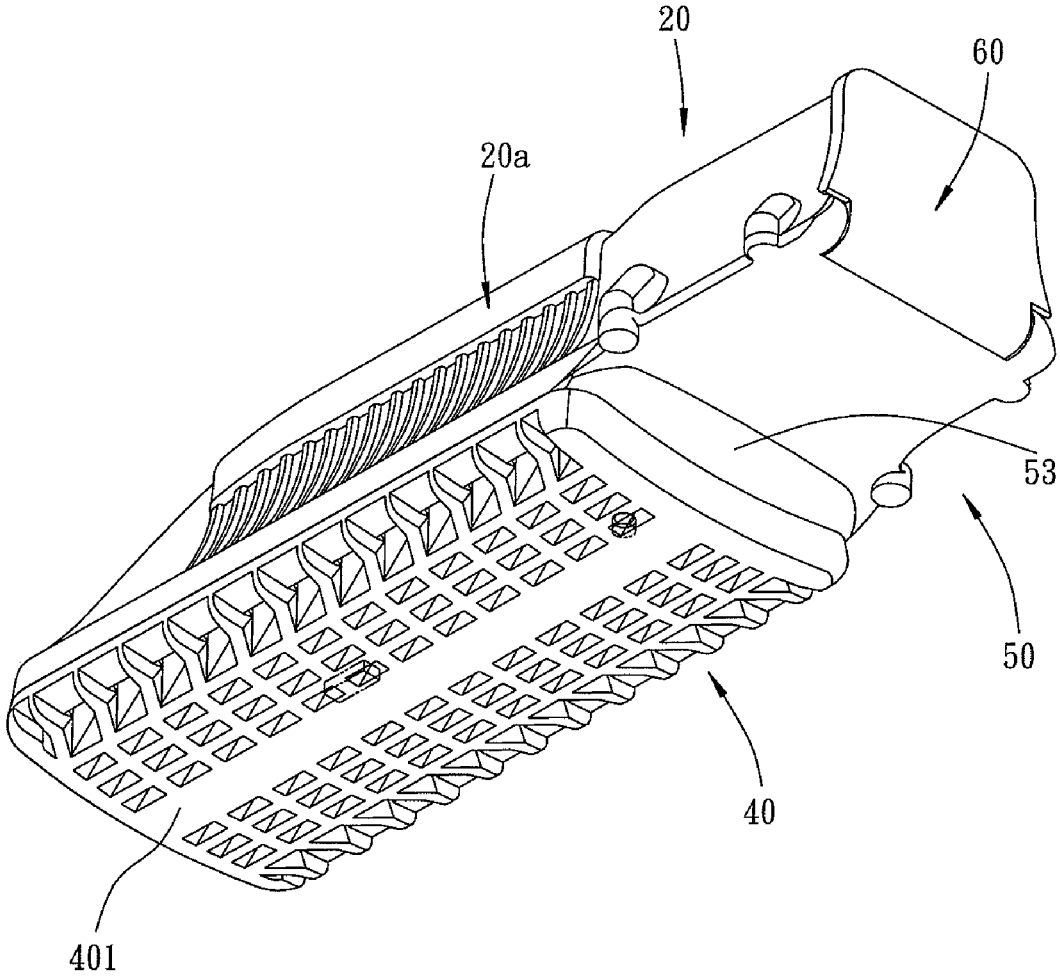
FIG. 6 is a bottom perspective view of the eraser as shown in FIG. 1.
Figure 7:
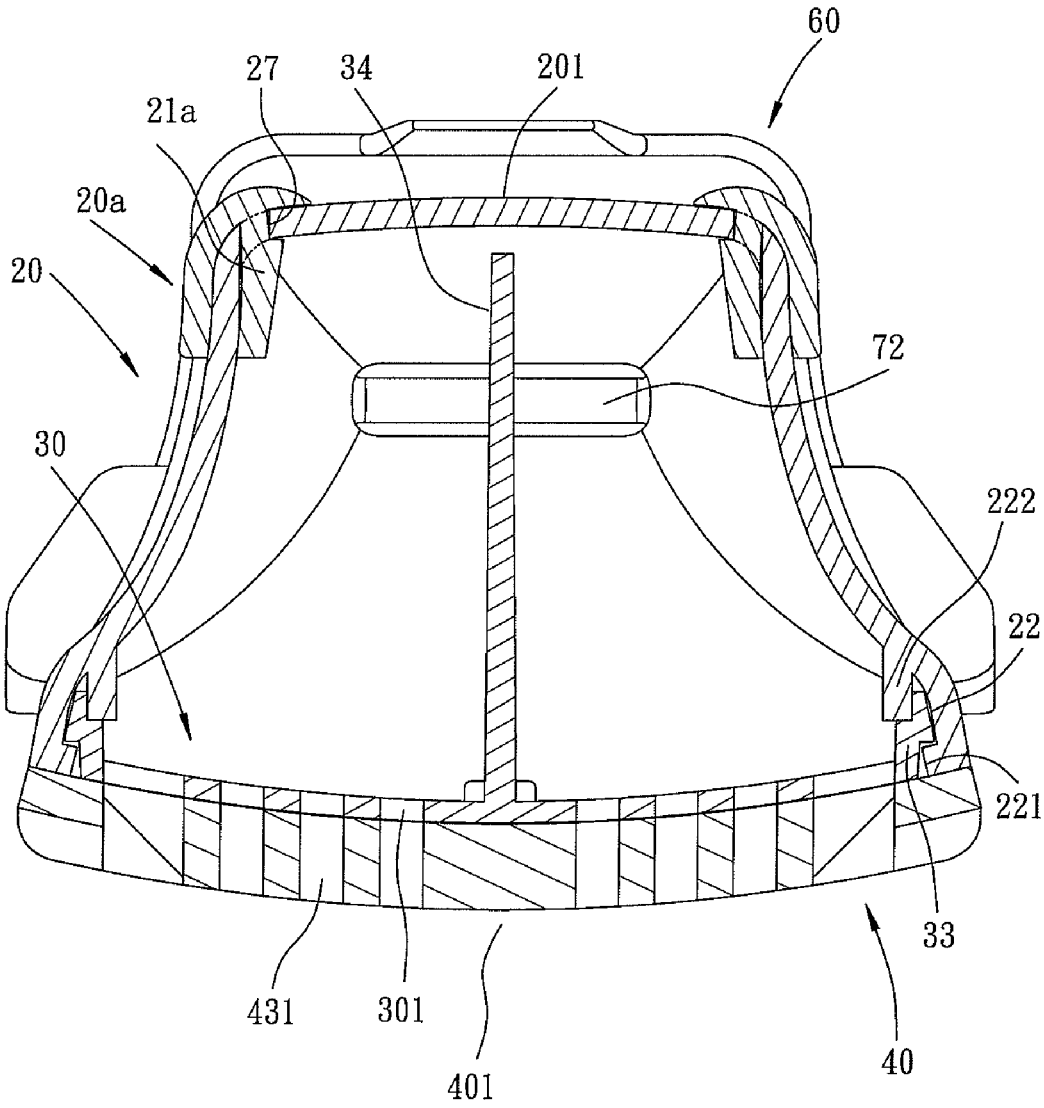
FIG. 7 is a front cross-sectional view of the eraser as shown in FIG. 1.
Figure 8:
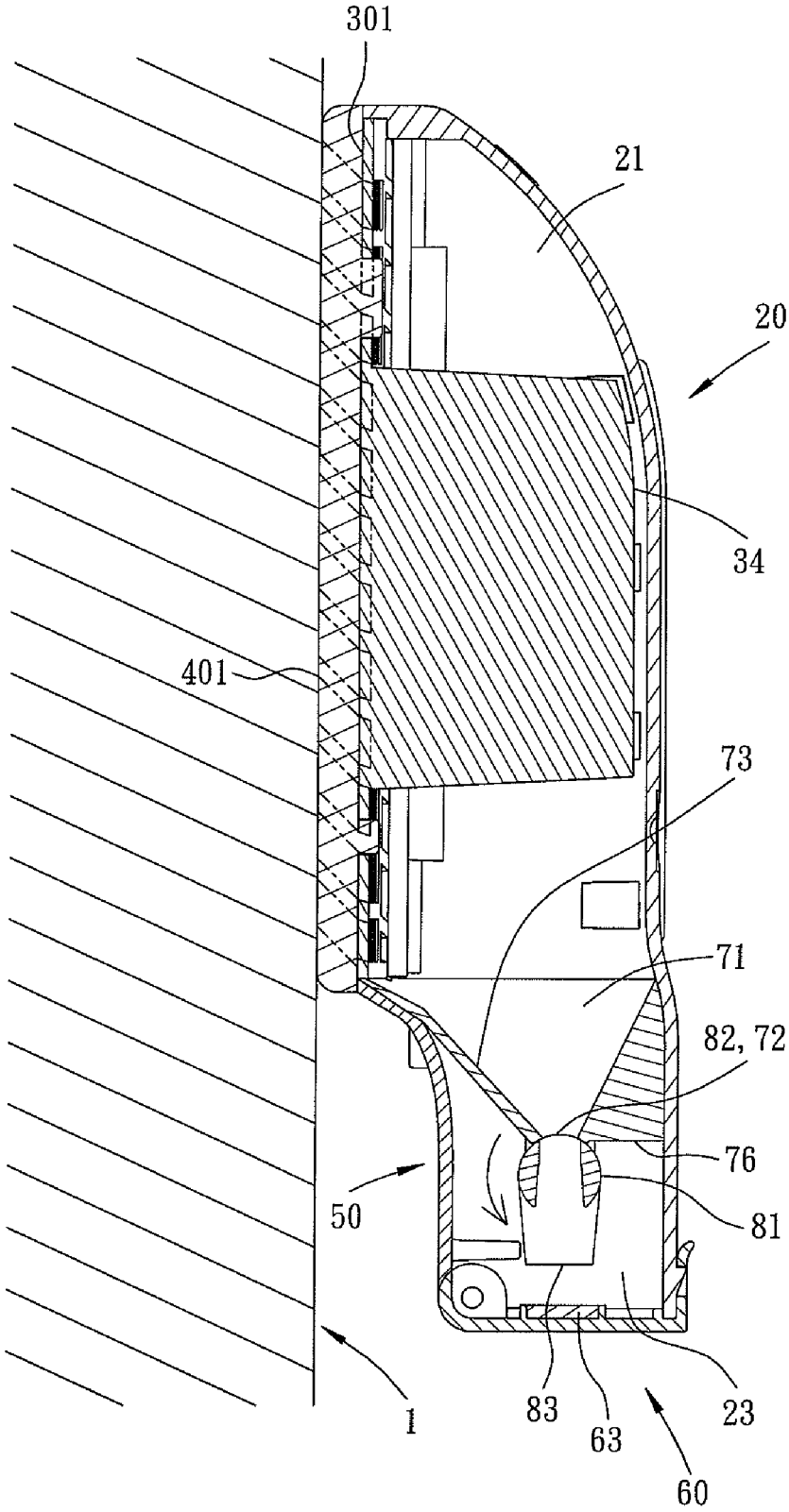
FIG. 8 is a schematic operational view of the eraser as shown in FIG. 5.

The control valve 80 is pivotally mounted between the support plates 75 of the separation member 70 and has two protruding pivot posts 84 each pivotally mounted in the pivot bore 74 of the respective support plate 75. The control valve 80 has a first end provided with a conduit 82 that is movable to align with the connecting bore 72 of the separation member 70 as shown in FIG. 8 so as to connect the receiving chamber 21 of the housing 20 with the collection zone 23 of the housing 20 and an arcuate stop face 81 that is movable to align with the connecting bore 72 of the separation member 70 as shown in FIG. 5 so as to interrupt the connection between the receiving chamber 21 and the collection zone 23 of the housing 20. The control valve 80 has a second end provided with at least one weight 83. The conduit 82 of the control valve 80 is disposed at a vertical state, and the stop face 81 of the control valve 80 is disposed at a horizontal state as shown in FIGS. 5 and 8 by the gravity of the weight 83 of the control valve 80.

Figure 9:
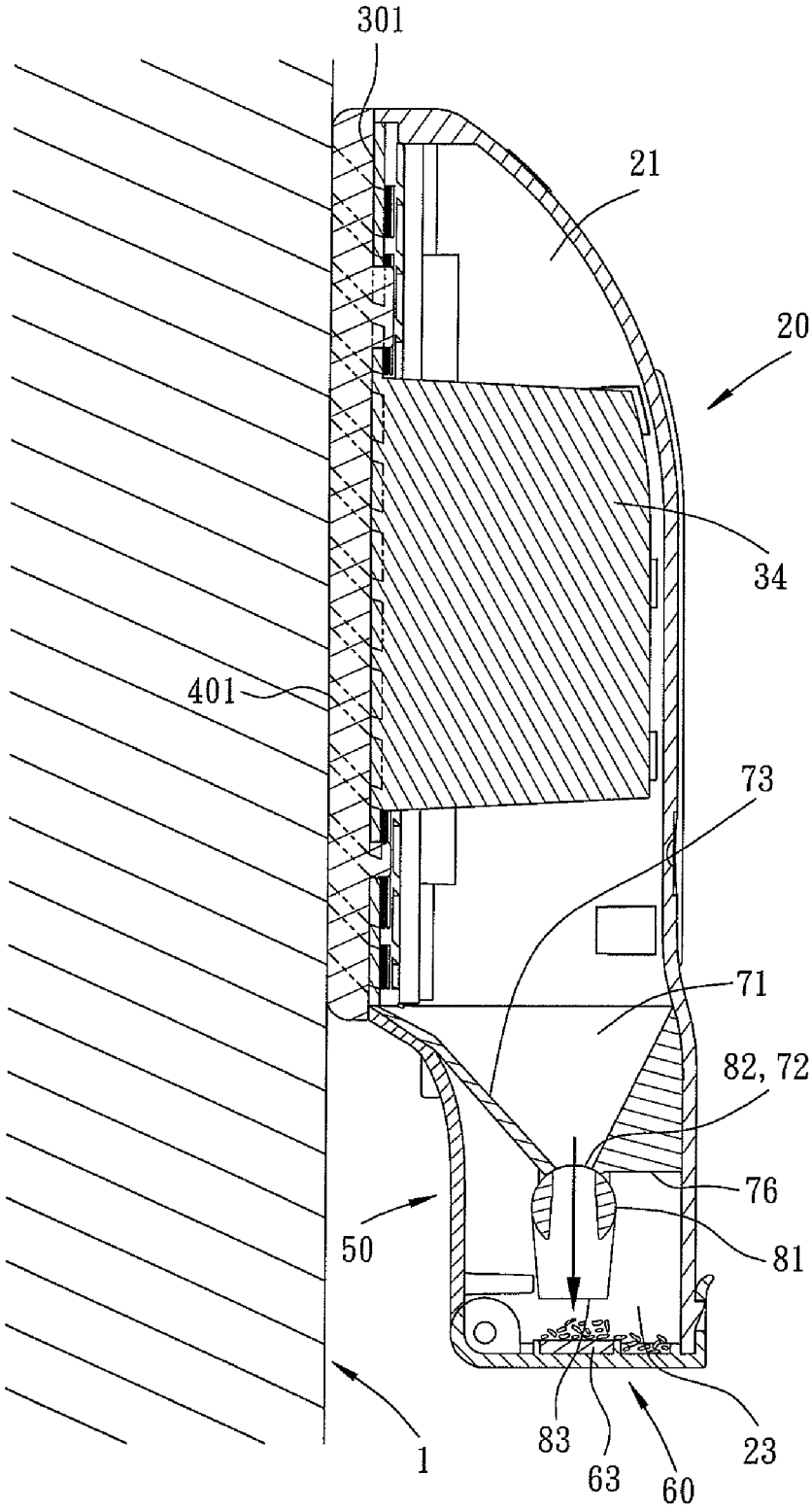
FIG. 9 is a schematic operational view of the eraser as shown in FIG. 8.

In operation, referring to FIGS. 8 and 9 with reference to FIGS. 1-7, when the housing 20 is disposed at a horizontal state as shown in FIG. 5, the conduit 82 of the control valve 80 is disposed at a vertical state, and the stop face 81 of the control valve 80 is disposed at a horizontal state by the gravity of the weight 83 of the control valve 80, so that the stop face 81 of the control valve 80 aligns with the connecting bore 72 of the separation member 70 to interrupt the connection between the receiving chamber 21 and the collection zone 23 of the housing 20. On the contrary, when the housing 20 is placed on a blackboard 1 and is disposed at a vertical state as shown in FIG. 8, the conduit 82 of the control valve 80 is disposed at a vertical state, and the stop face 81 of the control valve 80 is disposed at a horizontal state by the gravity of the weight 83 of the control valve 80, so that the conduit 82 of the control valve 80 aligns with the connecting bore 72 of the separation member 70 to connect the receiving chamber 21 of the housing 20 with the collection zone 23 of the housing 20. In such a manner, the chalks on the blackboard 1 are delivered through the guide slots 422 and the cleaning portions 421 of the first cleaning unit 42, the cleaning holes 431 of the second cleaning unit 43, the connecting holes 31 of the mounting board 30, the receiving chamber 21 of the housing 20, the opening 71 of the separation member 70, the guide face 73 of the separation member 70, the connecting bore 72 of the separation member 70 and the conduit 82 of the control valve 80 into the collection zone 23 of the housing 20 and are stopped by the door 60 as shown in FIG. 9.

Figure 10:
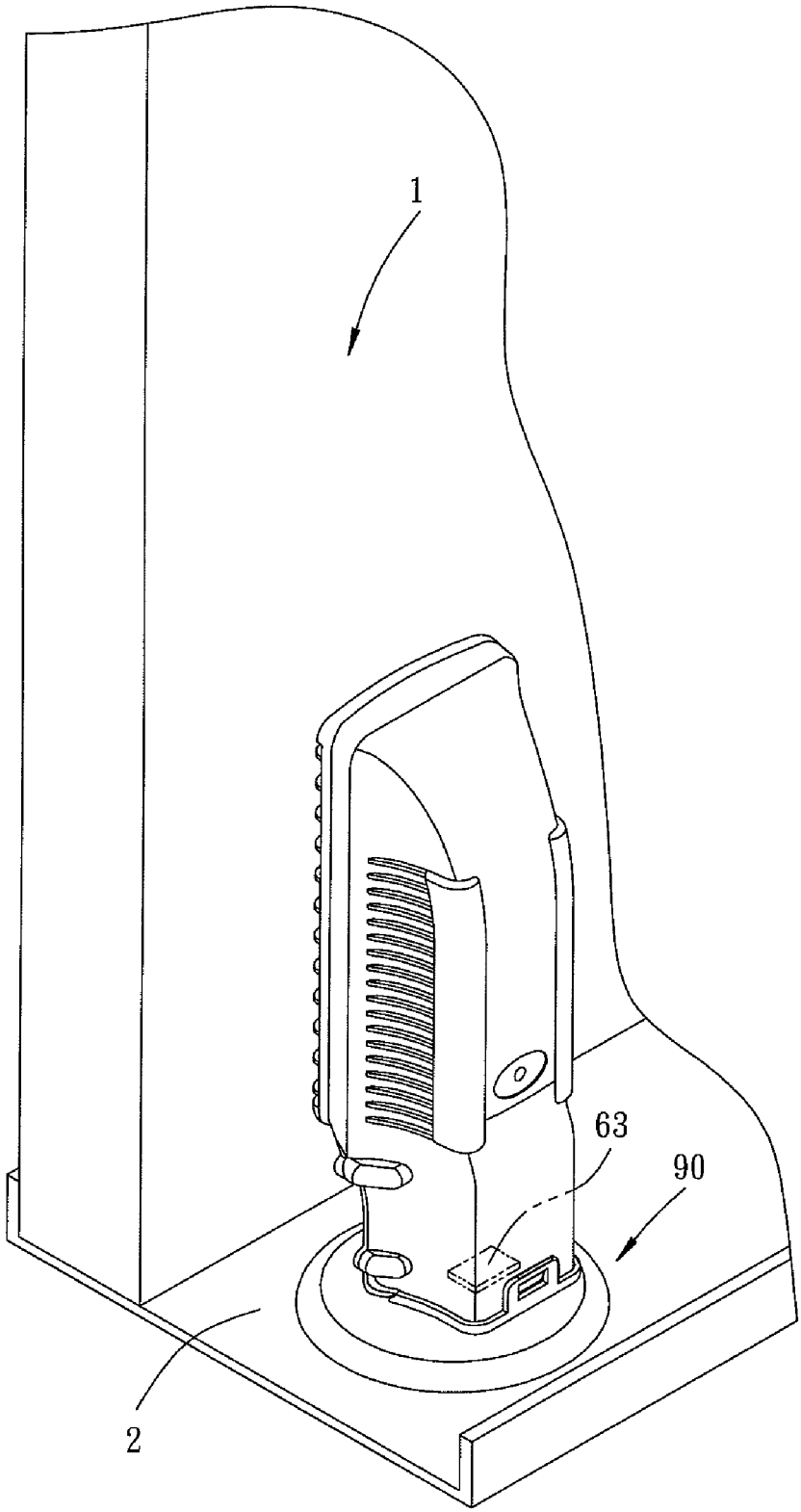
FIG. 10 is a perspective view of an eraser in accordance with another preferred embodiment of the present invention.
Figure 11:
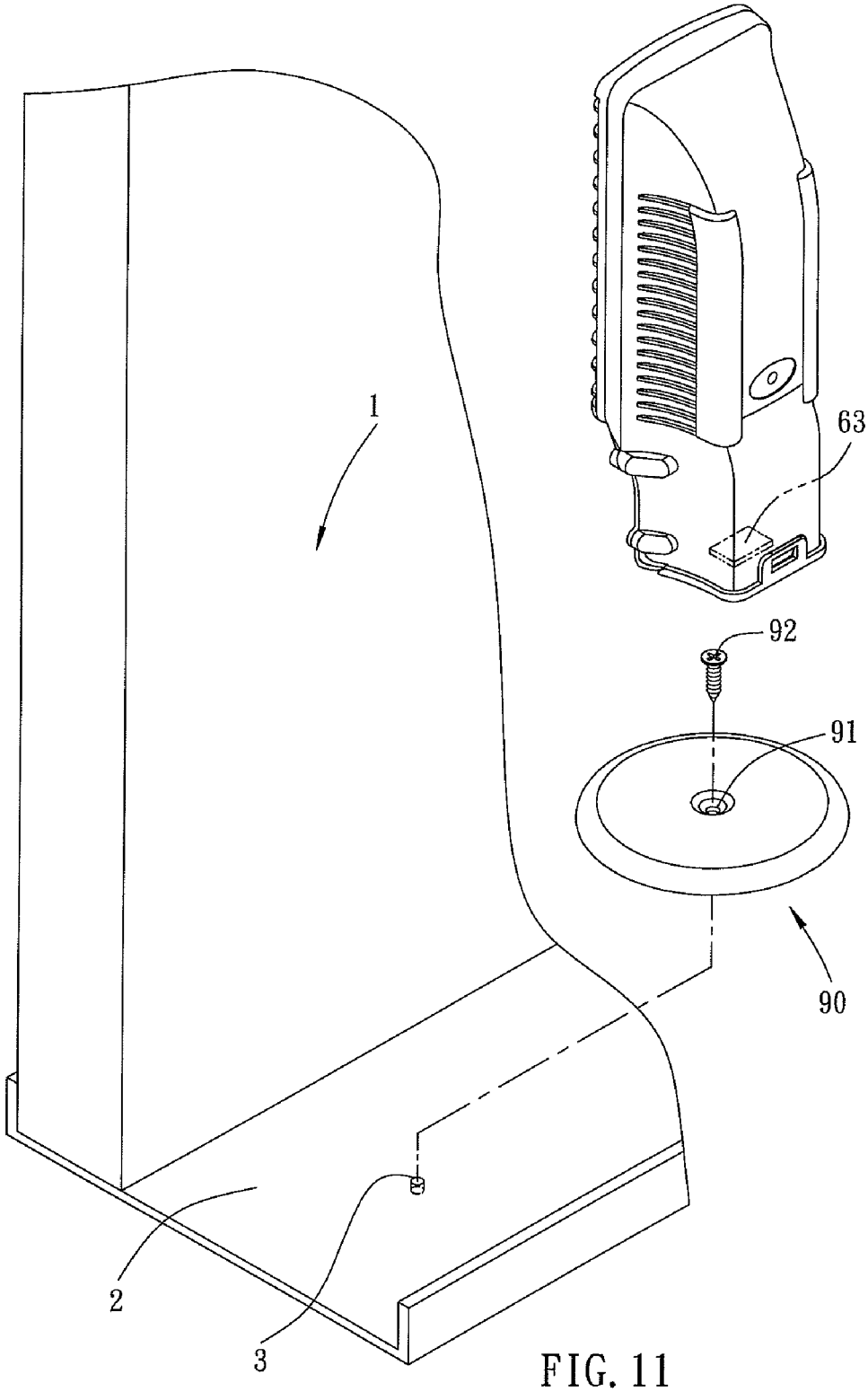
FIG. 11 is an exploded perspective view of the eraser as shown in FIG. 10.
Figure 12:
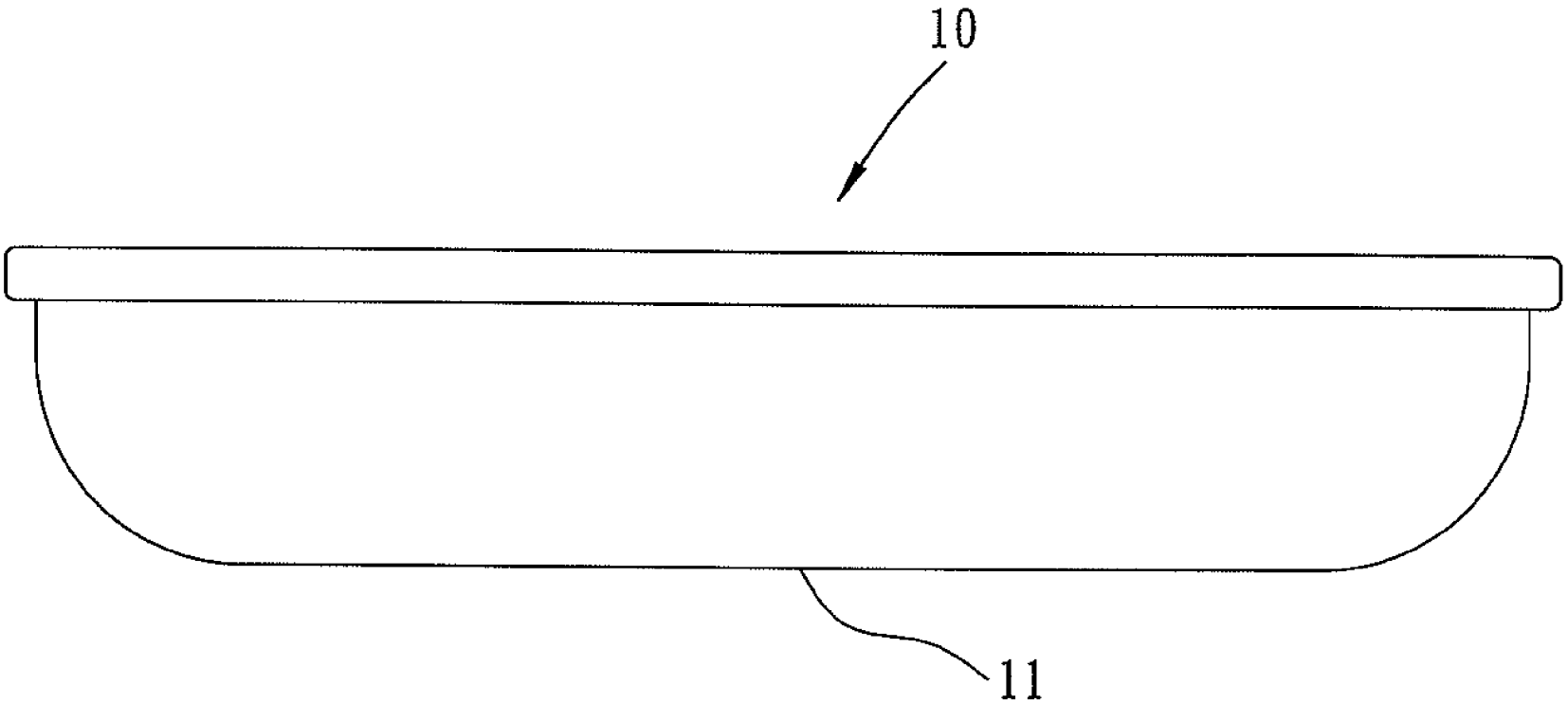
FIG.12 PRIOR ART
FIG. 12 is a front view of a conventional eraser in accordance with the prior art.

Referring to FIGS. 10 and 11, the eraser further comprises a magnetic seat 90 mounted on a bottom plate 2 of the blackboard 1 by a locking screw 92 for magnetically attracting the magnet 63 so as to attach the eraser to the blackboard 1. The locking screw 92 extends through a through hole 91 of the magnetic seat 90 and is screwed into a screw bore 3 of the bottom plate 2 of the blackboard 1.

Accordingly, the chalks on the blackboard 1 are delivered through the guide slots 422 and the cleaning portions 421 of the first cleaning unit 42, the cleaning holes 431 of the second cleaning unit 43 and the connecting holes 31 of the mounting board 30 into the receiving chamber 21 of the housing 20, so that the user can operate the cleaning member 40 easily and efficiently to place and store the chalks in the collection zone 23 of the housing 20 without having to clear the cleaning face 401 of the cleaning member 40 frequently. In addition, the decorative covers 20*a* abut the respective reinforcing ribs 26 of the housing 20 to enhance the whole strength of the housing 20. Further, the decorative covers 20*a* facilitate a user holding the housing 20.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. An eraser, comprising:

a housing (20) having an inner portion provided with a receiving chamber (21) and a collection zone (23) connected to the receiving chamber and having two opposite sides each provided with a plurality of reinforcing ribs (26);

a mounting board (30) mounted on an open bottom of the housing and connected to the receiving chamber of the housing;

a cleaning member (40) mounted on the mounting board and connected to the receiving chamber of the housing;

a support bracket (50) mounted on the open bottom of the housing and connected to the collection zone of the housing;

a door (60) pivotally mounted on the support bracket and removably mounted on the housing to cover the collection zone of the housing;

a hollow separation member (70) mounted in the housing and located between the receiving chamber and the collection zone of the housing to separate the receiving chamber of the housing from the collection zone of the housing;

a control valve (80) pivotally mounted on the separation member and movable relative to the separation member to open the separation member so as to connect the receiving chamber of the housing with the collection zone of the housing or to close the separation member so as to interrupt a connection between the receiving chamber and the collection zone of the housing;

two decorative covers (20*a*) mounted on the two opposite sides of the housing and each abutting the respective reinforcing ribs of the housing to enhance a whole strength of the housing.

2. The eraser of claim 1, wherein the mounting board has a plurality of connecting holes (31) each connected to the receiving chamber of the housing;

the cleaning member has a first cleaning unit (42) including a plurality of cleaning portions (421) and a second cleaning unit (43) including a plurality of cleaning holes (431) aligning with and connected to the connecting holes of the mounting board respectively.

3. The eraser of claim 2, wherein the first cleaning unit of the cleaning member further includes a plurality of guide slots (422) arranged between the cleaning portions.

4. The eraser of claim 2, wherein each of the cleaning portions of the first cleaning unit has an arcuate guide face (4211) and an oblique scraping face (4213).

5. The eraser of claim 2, wherein each of the cleaning holes of the second cleaning unit has at least one ramp (4312).

6. The eraser of claim 1, wherein the separation member has a first end provided with an opening (71) connected to the receiving chamber of the housing and a second end provided with a connecting bore (72) connected to the collection zone of the housing;

the control valve has a first end provided with a conduit (82) that is movable to align with the connecting bore of the separation member so as to connect the receiving chamber of the housing with the collection zone of the housing and an arcuate stop face (81) that is movable to align with the connecting bore of the separation member so as to interrupt the connection between the receiving chamber and the collection zone of the housing.

7. The eraser of claim 6, wherein the control valve has a second end provided with at least one weight (83);

the conduit of the control valve is disposed at a vertical state, and the stop face of the control valve is disposed at a horizontal state by the gravity of the weight of the control valve.

8. The eraser of claim 6, wherein the support bracket has a downward inclined resting portion abutting the mounting board and the separation member;

the opening of the separation member is flush with an inner wall of the housing and has a bottom abutting the mounting board.

9. The eraser of claim 1, further comprising:

a magnet (63) mounted on the door;

a magnetic seat (90) mounted on a bottom plate (2) of a blackboard (1) by a locking screw (92) for magnetically attracting the magnet so as to attach the eraser to the blackboard.

10. The eraser of claim 9, wherein the locking screw extends through a through hole of the magnetic seat and is screwed into a screw bore of the bottom plate of the blackboard.

11. The eraser of claim 1, wherein the housing has a plurality of fixing grooves;

each of the decorative covers has a plurality of fixing blocks locked in the fixing grooves of the housing.

12. The eraser of claim 1, wherein the housing has a plurality of sockets;

the support bracket has a plurality of plugs inserted into the sockets of the housing to secure the support bracket to the housing.

13. The eraser of claim 1, wherein the support bracket has two pivot ears each having a pivot stub;

the door has a first end provided with a pivot shaft pivotally mounted between the pivot ears of the support bracket and having two pivot holes each pivotally mounted on the pivot stub of the respective pivot ear.

14. The eraser of claim 13, wherein the housing has a top face provided with a locking block;

the door has a second end provided with a flexible locking plate having a locking hole detachably locked onto the locking block of the housing to removably lock the door onto the housing.

15. The eraser of claim 1, wherein the mounting board has a plurality of positioning holes;

the cleaning member has a plurality of positioning blocks inserted into and secured in the positioning holes of the mounting board to secure the cleaning member to the mounting board.

16. The eraser of claim 1, wherein the receiving chamber of the housing has two opposite sides each provided with at least one slot;

the mounting board has two opposite sides each provided with at least one insert inserted into and locked in the slot of the housing.

17. The eraser of claim 1, wherein the separation member has a tapered guide face located between the opening and the connecting bore;

the guide face of the separation member is tapered from the opening to the connecting bore.

18. The eraser of claim 1, wherein the separation member has two protruding support plates each having a pivot bore;

the control valve is pivotally mounted between the support plates of the separation member and has two protruding pivot posts each pivotally mounted in the pivot bore of the respective support plate.

19. The eraser of claim 1, wherein the mounting board has an arc-shaped support face abutting the cleaning member;

the cleaning member laminates the mounting board and has an arc-shaped cleaning face;

each of the decorative covers has an arc-shaped profile.

20. The eraser of claim 1, wherein the mounting board has an upright plate received in the receiving chamber of the housing;

the separation member has an upright resting plate abutting a top wall of the housing.

* * * * *